US006254010B1

(12) United States Patent
De Villiers

(10) Patent No.: US 6,254,010 B1
(45) Date of Patent: Jul. 3, 2001

(54) AIR DIFFUSERS

(75) Inventor: Noel De Villiers, Edgemead (ZA)

(73) Assignee: Brian Rickard (PTY) Ltd., Ottery (ZA)

( * ) Notice: Subject to any disclaimer, the term of this patent is extended or adjusted under 35 U.S.C. 154(b) by 0 days.

(21) Appl. No.: 09/550,861

(22) Filed: Apr. 17, 2000

(30) Foreign Application Priority Data

Apr. 19, 1999 (ZA) ..... 99/2788

(51) Int. Cl.[7] ..... F24F 7/00
(52) U.S. Cl. ..... 236/49.5; 454/258
(58) Field of Search ..... 236/49.5, 91 E, 236/99 E, 101 B; 454/258

(56) References Cited

U.S. PATENT DOCUMENTS

| | | | | |
|---|---|---|---|---|
| 4,231,513 | * | 11/1980 | Vance et al. | 236/49.5 |
| 4,491,270 | * | 1/1985 | Brand | 236/49.5 |
| 4,523,713 | * | 6/1985 | Kline et al. | 236/49.5 |
| 5,647,532 | | 7/1997 | deVilliers et al. | 236/49.5 |
| 5,860,592 | * | 1/1999 | Dozier et al. | 236/49.5 |
| 6,176,435 | * | 1/2001 | Nielsen | 236/49.5 |

* cited by examiner

*Primary Examiner*—William E. Tapolcai
(74) *Attorney, Agent, or Firm*—Ladas & Parry

(57) ABSTRACT

An air conditioning diffuser is disclosed which includes two temperature sensitive elements. A first element detects room temperature and a second element ducting temperature. When room temperature increases during supply of cooled air, the first element moves a control unit upwards and this results in a first disc of the control unit moving away from a surface on a pivotally mounted link. The link pivots about its mounting so that a baffle hanger and a baffle move down allowing more cooled air to flow through the diffuser. When heated air is being supplied, the second element displaces the unit in the upward direction so that baffle control is transferred from the first disc and the first link surface to a second disc and a second link surface. The link surfaces lie one radially inwardly and one radially outwardly of the link mountings. When room temperature rises, the first element moves the control unit up and the second disc bears on the second link surface lifting the baffle and limiting supply of heated air. The temperature at which the baffle reaches its most fully closed position is adjusted by moving the control unit relatively to the first and second elements.

9 Claims, 3 Drawing Sheets

AIR DIFFUSERS

FIELD OF THE INVENTION

THIS INVENTION relates to diffusers.

BACKGROUND TO THE INVENTION

The term "diffuser" is used to designate those devices which, in air conditioning systems, are employed for the purpose of regulating flow of air, which may be heated air or cooled air, from air conditioning ducting into a room.

Various conditions occur in an air conditioned room depending on whether the outside temperature is above that at which the room is to be maintained or below that at which the room is to be maintained.

In "Summer" conditions cooled air is fed from the air conditioning plant to the diffuser. If the room temperature is below that at which it is desired to maintain it, because cooled air has previously been fed in, then the diffuser must remain closed to prevent further cooled air entering the room.

As the room heats up a room temperature sensing element must detect this and open the diffuser to allow more cooled air into the room. The diffuser thus opens and closes as the room temperature varies.

In "Winter" conditions heated air is fed to the diffuser. If the room is above the requisite temperature, because heated air has previously been fed into the room, the diffuser must remain closed to prevent further heated air entering. As the room cools down, the room temperature sensing element must detect this and open the diffuser to allow more heated air in. The diffuser consequently opens and closes as the room temperature varies.

In the specification of our South African patent 96/4791 (U.S. Pat. No. 5,647,532 and Australian Patent No. 700908) there is disclosed a diffuser which has a single room temperature sensing element which closes a diffuser when the room is too cold (in Summer conditions) and close the diffuser when the room is too hot (in Winter conditions). This avoids the use of complex constructions involving two or more room temperature sensing elements.

BRIEF DESCRIPTION OF THE INVENTION

According to one aspect of the present invention there is provided a diffuser for controlling flow of air in an air conditioning system, the diffuser including an air flow control baffle, a first temperature sensitive element for sensing room temperature and having a first part which moves in response to changes in room temperature, first and second operating members connected to said first part for movement therewith in response to changes in room temperature, said members serving to move said baffle in opening and closing movements when they are themselves displaced by said first part of said first element, and a second temperature sensitive element for sensing the temperature in ducting through which heated and cooled air flows and having a second part which moves in response to ducting temperature variations, movements of said second part displacing said members between a first position in which one of them is effective to move the baffle in said opening and closing movements when cooled air is supplied to the ducting and a second position in which the other of said members is effective to move said baffle in said opening and closing movements when heated air is supplied to the ducting, there being means for adjusting the positions of said members with respect to said parts of said temperature sensitive elements.

The diffuser can include a framework on which said second temperature sensitive element is mounted, said framework being secured to and moving with said part of said first temperature sensitive element.

In the preferred form the diffuser includes a link, one end portion of which is pivotally mounted and the other end portion of which is connected to the baffle, said one end portion of the link including a first surface which is on the side of its pivotal mounting remote from its connection to the baffle and a second surface which is on the same side of its pivotal mounting as its connection to the baffle, said members being spaced apart with said link surfaces between them, said first surface being positioned to contact said first member and said second surface being positioned to contact said second member, forces exerted by said first and second members on said first and second surfaces pivoting the link in the direction which moves the baffle towards its closed position.

In this form there can be a unit having first and second spaced discs which are secured together so that they move rectilinearly along an axis, said first and second discs constituting said first and second members, said one end portion of said link being between said first and second discs whereby said first and second surfaces contact said first and second discs respectively, said link extending radially with respect to said axis, said first and second surfaces being one radially inwardly of the pivotal mounting of the link and the other radially outwardly of the pivotal mounting of the link.

Said unit can further include a third disc which moves in unison with said first and second discs, there being a lever pivotally mounted between its ends, said part of said second element displacing a first end of said lever in response to temperature variations in the ducting and a second end of said lever being between said second and third discs and serving to displace said unit and hence said first and second discs with respect to said one end portion of the link thereby selectively to bring said first disc and said first surface, or said second disc and said second surface, into co-operation with one another.

To provide a diffuser which is adapted to be mounted on a ceiling, said part of said first temperature sensitive element is connected, to and is co-axial with, a rod which, in use, is vertical and co-incident with said axis, said first disc being above the second disc and the third disc being below the second disc and said unit being moved upwardly with increasing room temperature and downwardly with decreasing room temperature, said second temperature sensitive element being orientated so that said first end of said lever is pushed down when heated air is flowing in the ducting whereby the second end of the lever lifts said unit upwardly with respect to said one end portion of said link.

The adjusting means is preferably an adjuster for moving said first end of said lever relatively to said part of said second element. In this constructional form said part of said second element is in the form of a threaded rod and said adjuster is screwed onto said rod, said adjuster including first and second axially spaced collars joined to one another by a sleeve, said first end of the lever being between said collars for movement thereby when the adjuster is displaced along said rod.

According to a further aspect of the present invention there is provided a diffuser for controlling flow of air in an air conditioning system, the diffuser including an air flow control baffle, a first temperature sensitive element for sensing room temperature and having a first part which moves in response to changes in room temperature, first and second operating members connected to said first part for movement therewith in response to changes in room temperature, said members serving to move said baffle in opening and closing movements when they are themselves displaced by said first part of said first element, and a second temperature sensitive element for sensing the temperature in ducting through which heated and cooled air flows and having a second part which moves in response to ducting temperature variations, movements of said second part displacing said members between a first position in which one of them is effective to move the baffle in said opening and closing movements when cooled air is supplied to the ducting and a second position in which the other of said members is effective to move said baffle in said opening and closing movements when heated air is supplied to the ducting, a lever pivotally mounted between its ends and forming the means for displacing said members between their first and second positions upon movement of said second part and an adjuster for displacing said lever so that the lever moves with respect to said second part and displaces said members with respect to said first part.

BRIEF DESCRIPTION OF THE DRAWINGS

For a better understanding of the present invention, and to show how the same may be carried into effect, reference will now be made, by way of example, to the accompanying drawings in which.

DETAILED DESCRIPTION OF THE DRAWINGS

Figure 1:
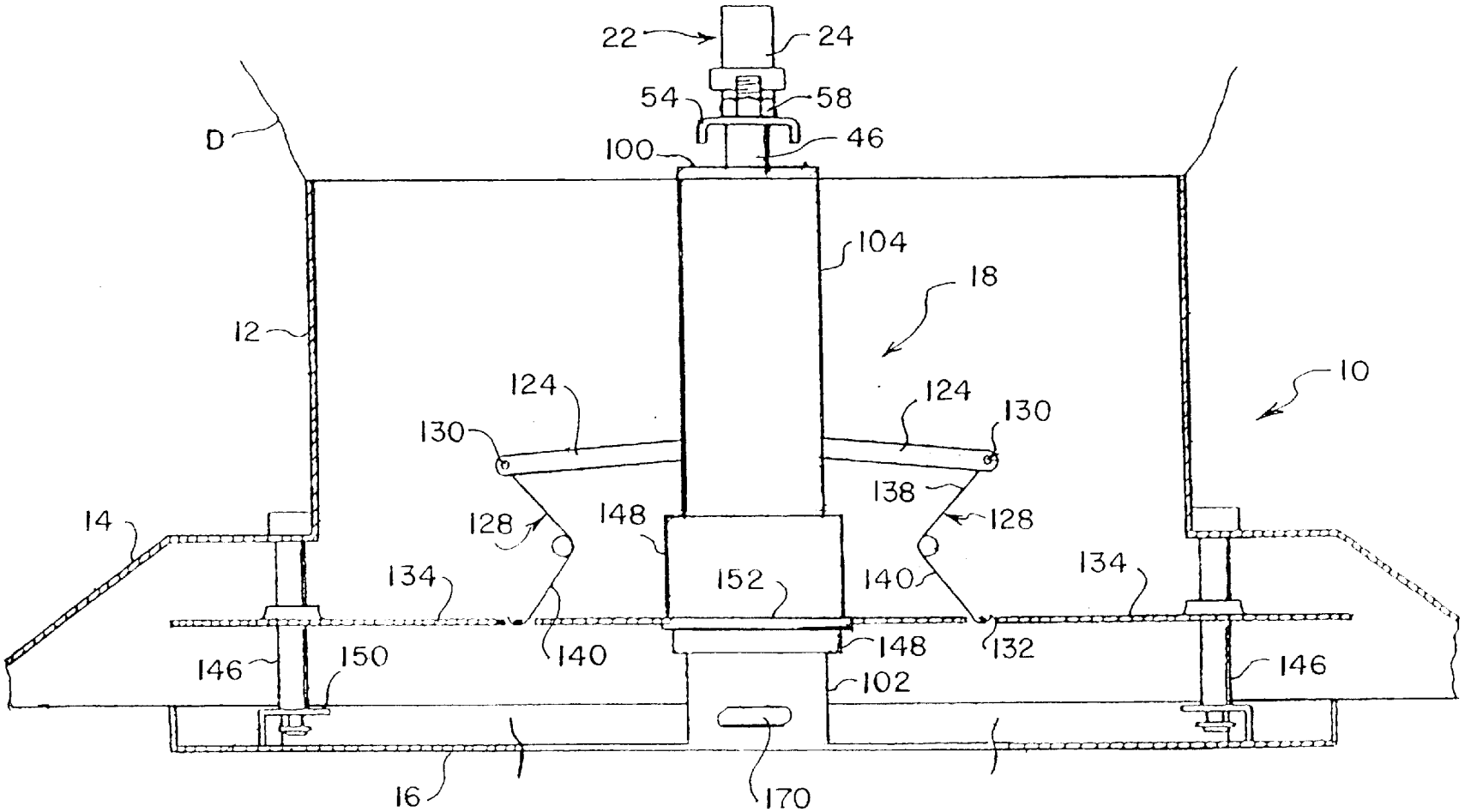
FIG. 1 diagrammatically illustrates a diffuser, FIG. 1 being partly in section and partly in elevation.

Referring firstly to FIG. 1 the diffuser 10 illustrated comprises a short vertical duct 12 which is connected at its upper end to the ducting D through which cooled air or heated air flows to the diffuser depending on the cooling or heating requirements which prevail. At the lower end of the duct 12 there is a truncated cone 14 which is mounted with its smaller end uppermost. At the wider lower end of the cone there is a trim disc 16 which conceals the operating mechanism, generally designated 18, of the diffuser 10. The trim disc 16 is constituted by a sheet of metal with an upturned rim. The lower end of the cone 14 is square or circular in shape and is bounded by a horizontal rim (not shown). This rim rests on the hangers (not shown) that are used to support the false ceiling in a building. The duct 12, ducting D and cone 14 are not shown in FIGS. 2 and 3. Only the centre part of the disc 16 is shown in FIGS. 2 and 3.

Figure 2:
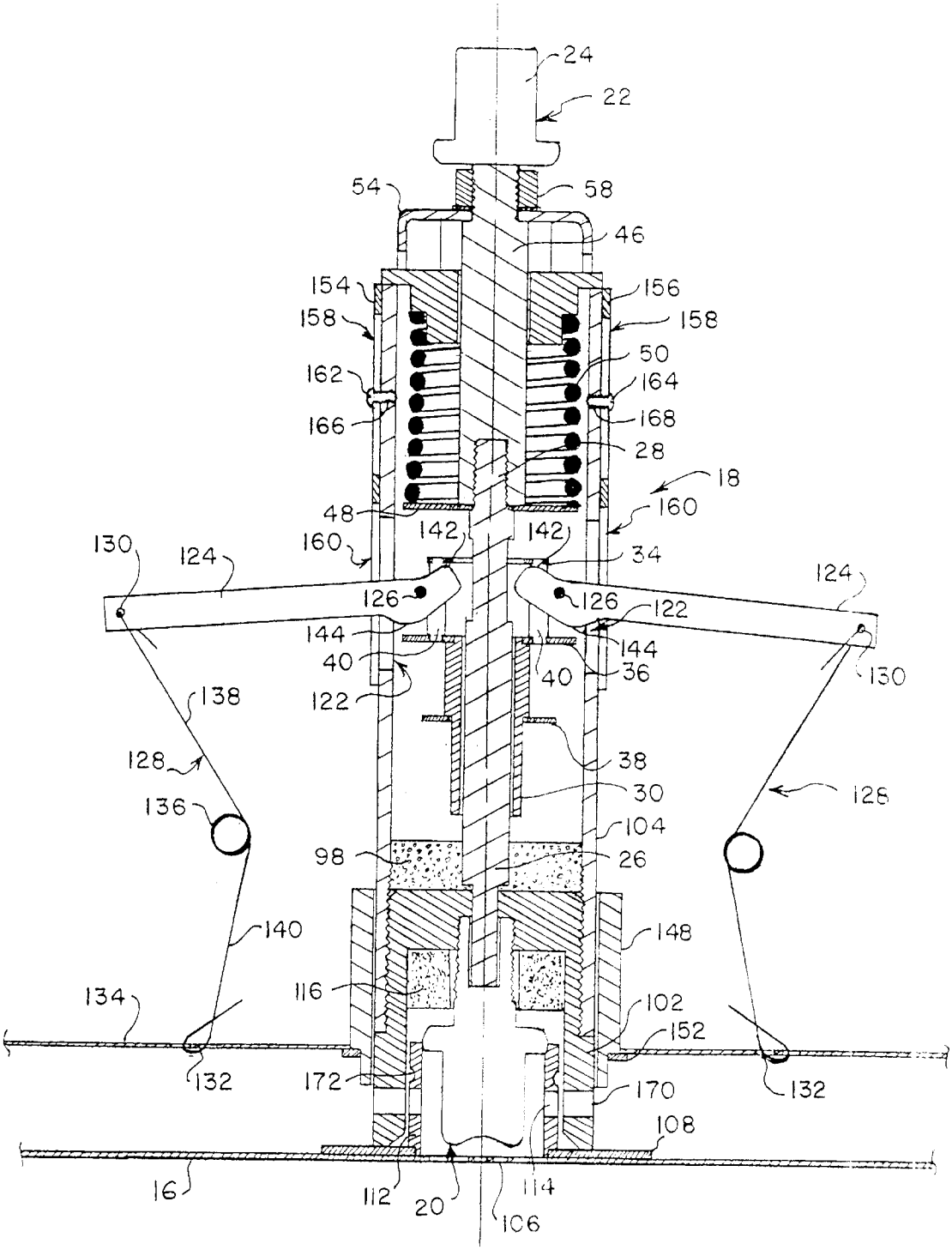
FIG. 2 is a vertical section through part of the diffuser of FIG. 1, FIG. 2 being to a larger scale than FIG. 1.
Figure 3:
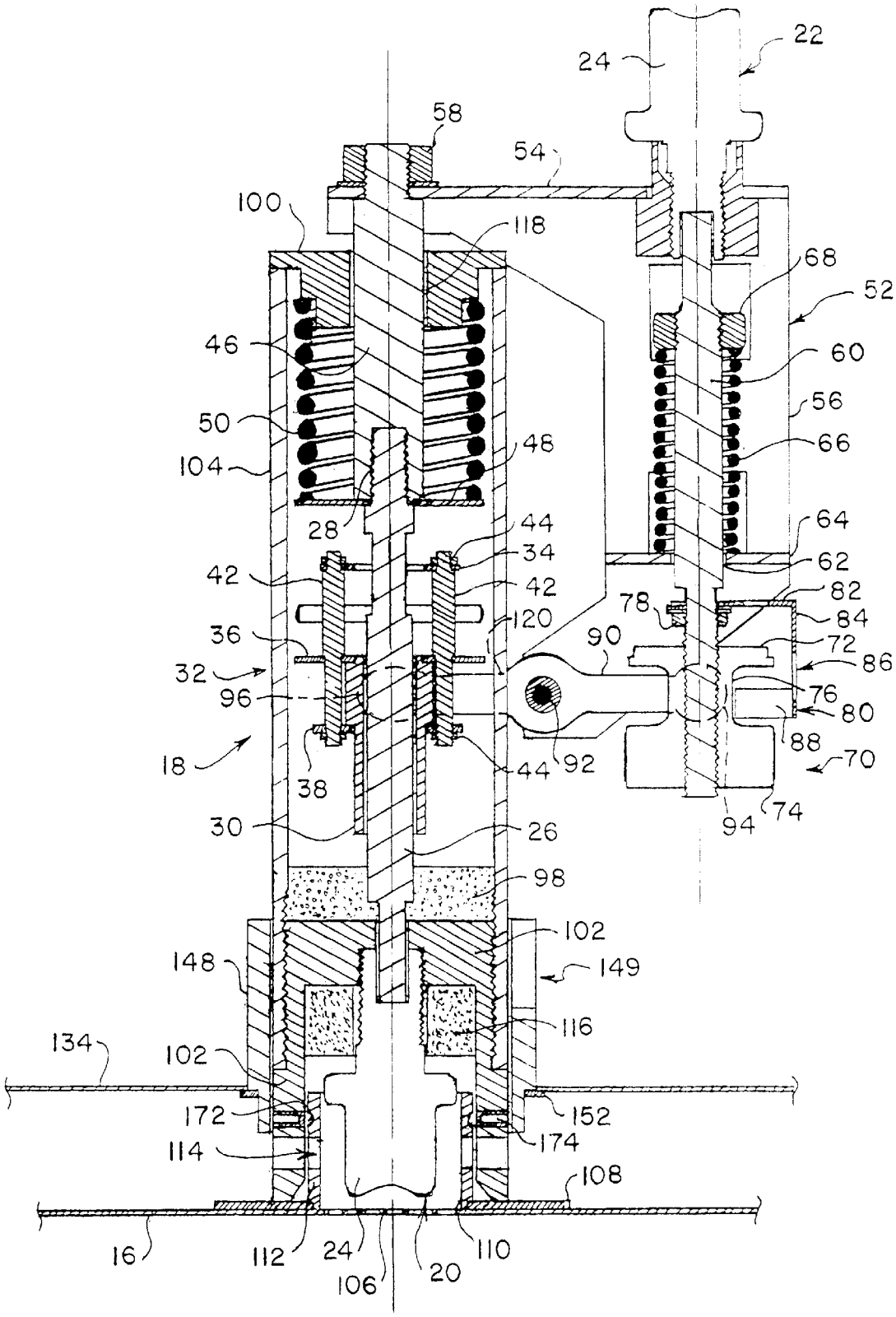
FIG. 3 is a vertical section through the diffuser part of FIG. 2 and taken at right angles to the section of FIG. 2.

The operating mechanism 18 is shown in detail in FIGS. 2 and 3 and comprises two thermally sensitive elements 20, 22 which in the art are often referred to as "pills". Each element 20, 22 comprises a housing 24 in which there is a wax that melts at a predetermined temperature and thereafter expands. One end of the housing 24 is closed and the other end of the housing 24 has an opening therein.

A rod 26 emerges from the housing 24 of the element 20 through the opening therein. On the part of the rod 26 within the housing 24 there is a piston (not shown). When the wax expands it pushes the piston in the direction which causes more of the rod 26 to protrude from the housing 24. A spring (which will be described hereinafter) is provided in association with the element 20 for pushing the rod 26 in the opposite direction, that is, back into the housing 24 when the wax contracts on cooling.

The upper end of the rod 26 has a turned down and threaded section 28.

The rod 26 passes freely through a bush 30 forming part of a control unit 32 (FIG. 2). The control unit 32 further includes three discs 34, 36 and 38. The discs 34 and 36 are held a fixed distance apart by two columns 40 (FIG. 2) opposite ends of which are attached to the discs 34 and 36. Pins 42 (FIG. 3) pass through holes in all three discs 34, 36, 38, the ends of the pins 42 being threaded and there being nuts 44 on the ends of the pins 42. The nuts 44 when tightened pull the discs 34 and 38 towards one another and against shoulders provided on the pins 42.

The bush 30 passes through a central hole in the disc 38 and is stepped so that it has a larger diameter upper part and smaller diameter lower part. The smaller diameter part extends from below the disc 38 through the hole in the disc 38. The disc 38 is thus below the step between the smaller and larger diameter parts and presses on the step when the disc 38 is pulled towards the disc 36 as the nuts 44 are tightened.

The upper end of the bush 30 bears on the underside of the disc 36 and presses it upwardly against further steps of the pins 42. Thus the columns 40 and bush 30 form spacers which hold the discs 34, 36 and 38 at the desired spacing when the nuts 44 are tightened.

A rod extension 46 has a tapped blind bore in the lower end thereof which receives the threaded end section 28 of the rod 26. A washer 48 is secured between a shoulder on the rod 26 and the extension 46. A spring 50 bears on the washer 48.

The element 22 is mounted parallel to the element 20. The housing 24 of the element 22 is secured to a rigid framework 52 (FIG. 3) which includes an arm 54 and a column 56, the arm 54 projecting from the upper end of the column 56 of the framework 52.

The arm 54 has a hole in the end thereof remote from the column 56 and the turned down and threaded upper end of the rod extension 46 passes through this hole. A nut 58 secures the arm 54 to the rod extension 46 so that the framework 52 and element 22 move rectilinearly with the rod 26 and rod extension 46.

A rod 60, equivalent to the rod 26, protrudes from the housing 24 of the element 22. The lower end of the rod 60 is guided in an opening 62 (FIG. 3) in a horizontal partition 64 forming part of the framework 52. A spring 66 acting between a nut 68 screwed onto the rod 60 and the fixed partition 64 serves as the return spring for the rod 60.

At the threaded lower end of the rod 60 there is a temperature set point adjuster generally designated 70 which is screwed onto the lower end of the rod 60. The adjuster 70 comprises spaced apart upper and lower collars 72 and 74 which are joined by a sleeve 76. The lower collar 74 is externally knurled so that it can be gripped for the purpose of rotating the adjuster 70 on the rod 60.

A nut 78 screwed onto the rod 60 secures a horizontal web 82 of a to bracket 80 between itself and a downwardly facing shoulder of the rod 60. A vertically extending flange 84 of the bracket 80 has a vertically extending slot 86 in it. The upper collar 72 has a line around the periphery thereof and this line can be seen through the slot 86. On each side of the slot 86 there are temperature graduation marks. Two arms 88 of the bracket 80 protrude into the space between the collars 72 and 74.

By turning the collar 74 it is possible to displace the entire adjuster 70 vertically on the rod 60, the arms 88 forming stops which prevent the adjuster 70 being moved too far in either direction.

Two parallel, horizontally spaced levers 90 (FIG. 3) are pivotally mounted by means of pins 92 on the framework 52. Each of the levers 90 has circular end portions 94 and 96. The rods 26 and 60 pass between the end portions 94 and 96 respectively of the levers 90. The portions 94 of the levers 90 fit snugly between the collars 72 and 74 and the end portions 96 fit snugly between the discs 36 and 38 of the unit 32. The fits are such that the levers 90 are free to pivot up and down about the pins 92 with respect to the collars 72, 74 and discs 36, 38. The lengths and positions of the levers 90 are such that a line, perpendicular to the plane of each lever 90, which passes through the centre points of the circular portions 94 intersects the longitudinal axis of the rod 60. Similarly, a line, perpendicular to the plane of each lever 90, which passes through the centre points of the portions 96, intersects the longitudinal axis of the rod 26.

Top and bottom caps 100 and 102 are mounted at opposite ends of a tube 104. The rod 26 and extension 46 are co-axial with the tube 104 and the element 20 screws into the cap 102. The bottom cap 102 screws into the lower end of the tube 104. Details of the cap 102, and other parts to be described hereinafter, have not been shown in FIG. 1.

The trim disc 16 has a plurality of slots 106 in the centre thereof and a rectangular plate 108 with a central opening 110 is secured to the top face of the disc 16 in such manner as not to cause any disfiguration of the visible underside of the disc. A sleeve 112 with apertures 114 in the wall thereof is welded to the plate 108 in register with the opening 110.

A thermally insulating ring 116 is provided around the upper part of the element 20 and a further thermally insulating ring 98 is provided above the cap 102.

The top cap 100 is a force fit in the upper end of the tube 104 and has a guide hole 118 in it through which the rod extension 46 passes freely. The cap 100 forms the second seat for the spring 50.

The tube 104 has horizontally spaced openings 120, one of which is shown in FIG. 3, in the wall thereof through which the levers 90 pass. The tube 104 also has two diametrically opposed openings 122 (FIG. 2) therein, the openings 122 both being displaced by approximately 90 degrees around the tube with respect to the openings 120. Two operating links 124 pass through the openings 122. The links 124 are pivotally mounted on the tube 104. The pivots consist of pins 126 spanning across the interior of the tube 104.

Hangers 128 (FIGS. 1 and 2) are pivotally mounted at 130 on the outer ends of the links 124 and pass through holes 132 in an airflow control baffle 134. Each hanger 128 is in the form of a spring which is fabricated using resiliently flexible wire. As best seen in FIG. 2, each hanger 128 has a central coil 136 and two arms 138 and 140. The hangers 128 pull the links 124 and baffle 134 towards one another.

The baffle 134 is disc-like and its periphery is close to the inner face of the cone 14 when the diffuser is closed (see FIG. 1). The lower ends of the arms 140 of the hanger 128 pass through the baffle 134 and are bent over to form hooks which lie below the baffle 134. The baffle 134 rests on the hooks and is supported thereby.

Each link 124 has two cam surfaces (FIG. 2). The first cam surface 142 of each link 124 co-operates with the underside of the disc 34. The second cam surface 144 of each link 124 co-operates with the top surface of the disc 36. The surfaces 142 are radially inwardly of the pivot pins 126 and the surfaces 144 are radially outwardly of the pins 126. The spacing between the surfaces 142 and 144 is less than the spacing between the discs 34 and 36.

Guide columns 146 (FIG. 1) are mounted on, and depend from, the cone 14. The lower ends of the columns 146 are connected to the trim disc 16 by brackets 150 so that the trim disc 16 is supported by the columns 146. The columns 146 pass through holes in the baffle 134 and form guides therefor.

A sleeve 148 is fixed to the baffle 134 by a circlip 152 and is co-axial with the tube 104. The sleeve 148 moves with the baffle 134 and with respect to the tube 104 and forms a central guide for the baffle 134. The sleeve 148 has a recess 149 in the upper edge thereof, the recess being generally rectangular when viewed in elevation.

Two vertically elongate guide plates 154 and 156 are mounted externally on the tube 104 so that they are diametrically opposed. The guide plates 154 and 156 each have a vertically elongate upper slot 158 which is closed at both its upper and lower ends and a vertically elongate lower slot 160 which is closed at its upper end and open at its lower end. When the plates 154, 156 are mounted on the tube 104, the slots 160 are aligned with the openings 122.

The plates 154, 156 are secured to the tube 104 by screws 162 and 164 inserted through the upper slots 158 and into bores 166 and 168 in the tube 104. Loosening of the screws 162, 164 allows the plates 154, 156 to be moved up and down to adjust the position of the slots 160 with respect to the openings 122. The lower ends of the plates 154, 156 limit the upward movement of the sleeve 148 and hence of the baffle 134. This prevents the baffle 134 from ever reaching a position in which the flow is totally prevented.

The end cap 102 has openings 170 in that part thereof which protrudes from the tube 104. The openings 170 register with the apertures 114 so that air can flow through the slots 106 to reach the element 20 and then flow out via the apertures 114 and openings 170.

The sleeve 112 has a circumferential groove 172 close to its upper end. Grub screws 174 carried by the cap 102 have their radially inner ends in the groove 172 thereby preventing separation of the tube 104 from the sleeve 112.

The element 20 senses room temperature and the element 22 detects duct temperature. On the assumption that cooled air is flowing in the ducting D, the rod 60 is fully retracted. The levers 90 are thus in the position illustrated in FIG. 3, the right hand ends 94 having been lifted by the collar 74. If it is further assumed that the room is cold, then the rod 26 and its extension 46 are in the lowermost position to which they were urged by the spring 50 when the wax in the element 20 contracted. The top disc 34 thus presses down, under the influence of the spring 50, on the surfaces 142 at the inner ends of the links 124. This pivots the outer ends of the links 124 upwardly. The hangers 128 are thus lifted and the baffle 134 is close to the cone 14. Little or no cooled air thus flows through the diffuser 10.

As the room heats up, the rod 26 and its extension 46 are pushed upwardly. The rod 26 slides through the bush 30 and the extension 46 lifts the framework 52 by raising the arm 54. The framework 52 lifts the levers 90 and these in turn lift the unit 32. There is consequently no relative movement between the unit 32 and the levers 90. The inner ends of the links 124 tilt upwardly as they are no longer held down by the disc 34 bearing on the surfaces 142. Tilting is caused by the mass of the baffle 134, hangers 128 and the outer parts of the links 124. As the baffle 134, hangers 128 and outer parts of the links 124 move down, the gap between the cone 14 and the baffle 134 increases and cooled air flows into the room. As the room cools down, the wax in the element 20 contracts and the spring 50 pushes the rod 26, and hence the control unit 32, down. The disc 34 pushes on the surfaces 142 of the inner ends of the links 124 tilting the inner ends downwardly and the outer ends upwardly. The result is that the baffle 134 moves up towards the cone 14 closing-off the annular gap and reducing the amount of air flow. The upper limit of the movement of the baffle 134 is determined by the setting of the plates 154, 156 the lower ends of which the sleeve 148 engages as the baffle rises. The recess 149 receives the lower end of the framework 52 when the baffle 134 is in its raised position.

As explained, the framework 52, element 22, rod 60, collars 72, 74 and levers 90 all move up and down with the rod 26. There is thus no relative movement between the discs 36,38 and the levers 90 as the temperature of the element 20 varies. Consequently, the unit 32 does not move with respect to the rod 26.

In cool or cold atmospheric conditions, heated air flows in the ducting D and the wax in the thermally sensitive element 22 expands pushing the rod 60 down against the action of the spring 66. The end portions 94 of the levers 90 between the collars 72, 74 are thus moved down and the end portions 96 between the discs 36, 38 move up, lifting the control unit 32. As the disc 34 moves up, the inner ends of the links 124 are not now restrained. The mass of the baffle 134, hangers 128 and outer parts of the links 124 causes the links 124 to pivot about the pins 126. The hangers 128 are lowered and the baffle 134 descends to the fully open position of the diffuser 10. In this position the maximum amount of heated air can flow into the room so as to raise its temperature. This is the condition that prevails when the heating system is switched on in the morning.

As the room heats up, the wax in the thermally sensitive element 20 expands and pushes the rod 26, the framework 52, the levers 90 and hence the control unit 32 upwardly. The disc 36 acts on the surfaces 144 of the links 124 and pivots them in the direction which lifts the hangers 128 and the baffle 134 thereby closing-off heated air flow. As the room cools, the rod 26, framework 52, links 124 and operating unit 32 move down under the influence of the spring 50 as the wax contracts and this allows more heated air to flow into the room.

The temperature at which the diffuser 10 is fully open is adjusted by rotating the adjuster 70 on the rod 60. This displaces the adjuster 70 vertically, tilting the levers 90 clockwise or anti-clockwise about the pivots 92. More specifically the circular portions 94 of the levers 90 are forced upwardly or downwardly, the portions 96 moving in the opposite direction. Hence the position of the unit 32 on the rod 26 is adjusted, simultaneously moving the links 124, hangers 128 and baffle 134 whilst the rod 26 remains stationary. The set temperature can be read from the temperature graduations on the flange 84 and the line on the collar 72.

What is claimed is:

1. A diffuser for controlling flow of air in an air conditioning system, the diffuser including an air flow control baffle, a first temperature sensitive element for sensing room temperature and having a first part which moves in response to changes in room temperature, first and second operating members connected to said first part for movement therewith in response to changes in room temperature, said members serving to move said baffle in opening and closing movements when they are themselves displaced by said first part of said first element, and a second temperature sensitive element for sensing the temperature in ducting through which heated and cooled air flows and having a second part which moves in response to ducting temperature variations, movements of said second part displacing said members between a first position in which one of them is effective to move the baffle in said opening and closing movements when cooled air is supplied to the ducting and a second position in which the other of said members is effective to move said baffle in said opening and closing movements when heated air is supplied to the ducting, there being means for adjusting the positions of said members with respect to said parts of said temperature sensitive elements.

2. A diffuser as claimed in claim 1 and including a framework on which said second temperature sensitive element is mounted, said framework being secured to and moving with said part of said first temperature sensitive element.

3. A diffuser as claimed in claim 1, and including a link, one end portion of which is pivotally mounted and the other end portion of which is connected to the baffle, said one end portion of the link including a first surface which is on the side of its pivotal mounting remote from its connection to the baffle and a second surface which is on the same side of its pivotal mounting as its connection to the baffle, said members being spaced apart with said link surfaces between them, said first surface being positioned to contact said first member and said second surface being positioned to contact said second member, forces exerted by said first and second members on said first and second surfaces pivoting the link in the direction which moves the baffle towards its closed position.

4. A diffuser as claimed in claim 3, and including a unit having first and second spaced discs which are secured together so that they move rectilinearly along an axis, said first and second discs constituting said first and second members, said one end portion of said link being between said first and second discs whereby said first and second surfaces contact said first and second discs respectively, said link extending radially with respect to said axis, said first and second surfaces being one radially inwardly of the pivotal mounting of the link and the other radially outwardly of the pivotal mounting of the link.

5. A diffuser as claimed in claim 4 wherein said unit includes a third disc which moves in unison with said first and second discs, there being a lever pivotally mounted between its ends, said part of said second element displacing a first end of said lever in response to temperature variations in the ducting and a second end of said lever being between said second and third discs and serving to displace said unit and hence said first and second discs with respect to said one end portion of the link thereby selectively to bring said first disc and said first surface, or said second disc and said second surface, into cooperation with one another.

6. A diffuser as claimed in claim 5, wherein said part of said first temperature sensitive element is connected to, and is co-axial with a rod which, in use, is vertical and co-incident with said axis, said first disc being above the second disc and the third disc being below the second disc and said unit being moved upwardly with increasing room temperature and downwardly with decreasing room temperature, said second temperature sensitive element being orientated so that said first end of said lever is pushed down when heated air is flowing in the ducting whereby the second end of the lever lifts said unit upwardly with respect to said one end portion of said link.

7. A diffuser as claimed in claim 5, wherein the adjusting means is an adjuster for moving said first end of said lever relatively to said part of said second element.

8. A diffuser as claimed in claim 7, wherein said part of said second element is in the form of a threaded rod and said adjuster is screwed on to said rod, said adjuster including first and second axially spaced collars joined to one another by a sleeve, said first end of said lever being between said collars for movement thereby when the adjuster is displaced along said rod.

9. A diffuser for controlling flow of air in an air conditioning system, the diffuser including an air flow control baffle, a first temperature sensitive element for sensing room temperature and having a first part which moves in response to changes in room temperature, first and second operating members connected to said first part for movement therewith in response to changes in room temperature, said members serving to move said baffle in opening and closing movements when they are themselves displaced by said first part of said first element, and a second temperature sensitive element for sensing the temperature in ducting through which heated and cooled air flows and having a second part which moves in response to ducting temperature variations, movements of said second part displacing said members between a first position in which one of them is effective to move the baffle in said opening and closing movements when cooled air is supplied to the ducting and a second position in which the other of said members is effective to move said baffle in said opening and closing movements when heated air is supplied to the ducting, a lever pivotally mounted between its ends and forming the means for displacing said members between their first and second positions upon movement of said second part and an adjuster for displacing said lever so that the lever moves with respect to said second part and displaces said members with respect to said first part.

* * * * *